US008819964B2

(12) United States Patent
Mizrahi-Shapiro

(10) Patent No.: US 8,819,964 B2
(45) Date of Patent: Sep. 2, 2014

(54) SANDAL WITH REMOVABLE STRAPS

(76) Inventor: Eduardo Nuri Mizrahi-Shapiro, Naucalpan (MX)

( * ) Notice: Subject to any disclaimer, the term of this patent is extended or adjusted under 35 U.S.C. 154(b) by 469 days.

(21) Appl. No.: 13/187,933

(22) Filed: Jul. 21, 2011

(65) Prior Publication Data

US 2013/0019496 A1 Jan. 24, 2013

(51) Int. Cl.
*A43B 3/12* (2006.01)
*A43B 3/24* (2006.01)

(52) U.S. Cl.
CPC . *A43B 3/12* (2013.01); *A43B 3/244* (2013.01); *A43B 3/122* (2013.01); *A43B 3/242* (2013.01)
USPC ..... 36/100; 36/11.5

(58) Field of Classification Search
CPC ..... A43B 3/12; A43B 3/122; A43B 3/24; A43B 3/242; A43B 3/2424
USPC ..... 36/100, 101, 11.5, 132, 136
See application file for complete search history.

(56) References Cited

U.S. PATENT DOCUMENTS

| | | | | |
|---|---|---|---|---|
| 6,349,486 | B1 * | 2/2002 | Lin | 36/101 |
| 7,222,441 | B2 | 5/2007 | Smith et al. | |
| 7,540,098 | B2 | 6/2009 | Bast et al. | |
| 7,694,436 | B2 * | 4/2010 | Mullen | 36/11.5 |
| 8,171,654 | B2 * | 5/2012 | Rudd et al. | 36/11.5 |
| 8,434,246 | B2 * | 5/2013 | Enderson | 36/101 |
| 8,438,758 | B2 * | 5/2013 | Stonisch | 36/101 |
| 8,448,351 | B2 * | 5/2013 | Aveni | 36/11.5 |
| 2011/0239484 | A1 * | 10/2011 | Giovannetti | 36/11.5 |

* cited by examiner

*Primary Examiner* — Jila M Mohandesi
(74) *Attorney, Agent, or Firm* — Browdy and Neimark, PLLC

(57) ABSTRACT

A sandal is described, which includes a sole, straps holding the sole to a user's foot, and a first a second plurality of orifices located at the sole, wherein the orifices of the first plurality are perpendicularly oriented to the orifices of the second plurality forming a "cross" and the straps, in order to be attached to the sole, are removable inserted into the cross formed by the first and second plurality of orifices.

13 Claims, 10 Drawing Sheets

SECTION C-C′

SECTION C-C′

SECTION A-A'

SANDAL WITH REMOVABLE STRAPS

TECHNICAL FIELD

The present invention is related to the techniques employed in the shoe industry, for the design and manufacture of articles to cover and keep safe the foot, and more particularly, it is related to a sandal with removable straps.

BACKGROUND OF THE INVENTION

Shoes are part of the garments used to cover and protect feet, having many shapes such as, but not limited to, shoes, high heels, boots, sandals or tennis.

Shoes are used for various reasons, including feet protection, hygiene or decoration only.

Often socks or stockings are used with shoes, or on the contrary, bare feet when using sandals.

In the prior art there are patent documents describing sandals with exchangeable strips or straps, such as U.S. Pat. No. 7,222,441 related to a sandal with an interchangeable strip including a sole portion and a section encasing or surrounding the instep. The section encasing the instep is removable attached to a first and second side ends, adjacent to the inner and outer edges of the sole portion, respectively. When the section encasing the instep is removed from the sole portion, a second section substitutes said first section surrounding the instep. The section surrounding the instep is attached to the sole portion using at least a pair of side hooks having the size and shape to removable engage a pair of engaging hooks located at the sole portion. The engaging hooks are moved from a first engaging position to a second disengaging position by at least one engaging actuator. Lateral hooks and engaging hooks may be horizontally or vertically oriented. One alternative section surrounding the instep has a portion separating the toe and securing the sole side and front portions. However, a drawback in this type of sandals is that the hook-engaging strip ends and the sole groove structure are more complex, thus, the manufacturing tool kit is more expensive.

Likewise, in U.S. Pat. No. 7,540,098, a sandal with an exchangeable slipper is described, which allows the user to have a unique pair of soles and multiple slippers, thus allowing having sandals of multiple styles and colors without having to purchase and store multiple entire sandals. The sandals have a sole and a top portion wherein said top portion is generally comprised by strips having a "Y" shape. The top portion at the "Y" upper end may vary in size and design as the top portion has at least three different strip ends being used as attachment points to the sole. The front attachment point, at the "Y" bottom, is joined at the sole front using a first opening extending from the top surface to the bottom surface at the front part of the sole. The rear attachment points are located at the "Y" upper strap ends. These might be a single point at each side, or due to aesthetics, these points may divert in two or more strip ends. Each side may have a different number of strip ends. This kind of sandals have the great drawback of including screws to secure the top portion rear attachment ends in "Y" shape to the sole, wherein the screw threads may wear out with time and stop working.

OBJECTS OF THE INVENTION

Considering the prior art drawbacks, it is an object of the present invention to provide a sandal with removable straps, of a very simple design and manufacture, but practical to remove and exchange the straps of the sole without using tools or devices.

Another object of the present invention is to provide a sandal with removable straps allowing the user having a single pair of soles and multiple removable straps in different styles and colors.

Yet another object of the present invention is to provide a sandal with removable straps allowing a simple and non-expensive change of the damaged straps, since there is no need to change the whole sandal.

BRIEF DESCRIPTION OF THE INVENTION

The present invention is related to a sandal of the type comprising a sole having an upper surface and a lower surface, as well as a front portion and a rear portion, along with a left side edge and a right side edge, said sole holds to a user's foot using holding means located at the sandal upper portion, wherein the sandal is characterized by having said holding means removable attached to the sole.

The sole includes a first plurality of orifices which longitudinal axis is parallel to said sole longitudinal axis, which extends from the upper surface to the lower surface throughout the sole thickness. Likewise, the sole includes a second plurality of orifices which longitudinal axis is perpendicular to the sole longitudinal axis, which extend from the lower surface to the inside of the sole thickness without passing through. Said orifices from the first plurality are perpendicularly oriented with the orifices of the second plurality forming a "cross", thereby allowing the removable attachment of the holding means to the sole.

The holding means are a body configured in "Y" shape having at least three integral straps, the first being located at the "Y" bottom portion of the holding means body, forming the front anchorage point; a second strap located at the "Y" left upper portion; a third strap located at the "Y" right upper portion; wherein said second and third straps form the rear anchorage points, respectively, and said second and third straps have the same length and width dimensions, while the first strap is shorter and narrower than said second and third straps. Wherein the first, second and third strap ends are configured such that allow their housing in the fourth, fifth and sixth orifices, respectively, of the second plurality of orifices located at the sole lower surface, thereby forming the front and rear anchoring points.

In order to fix the holding means to the sole to form the sandal, the first strap end is rotated 90° and is inserted in the first orifice of the first plurality of orifices, from the upper surface to the lower surface, and once having passed throughout the sole thickness, it rotates 90° again returning it to its starting position, and then it is housed in the fifth orifice of the second plurality of orifices thereby forming the front anchorage point; and, in order to form the rear anchorage points, the same procedure of insertion and housing carried out to form the front anchorage point is followed, i.e., each second and third strap ends is rotated 90° and inserted in the second and third orifices, respectively, of the first plurality of orifices, until having passed throughout the sole thickness, to further rotate 90° again returning them to their starting position, and thereby housing them in the fifth and sixth orifices, respectively, of the second plurality of orifices.

BRIEF DESCRIPTION OF THE DRAWINGS

The novel aspects considered characteristics of the present invention will be particularly set-forth in the appended claims. However, the invention, for both its organization and operating method, together with other objects and advantages thereof, will be better understood in the following detailed description of certain embodiments, when read related to the accompanying drawings, wherein:

DETAILED DESCRIPTION OF THE INVENTION

Figure 1:
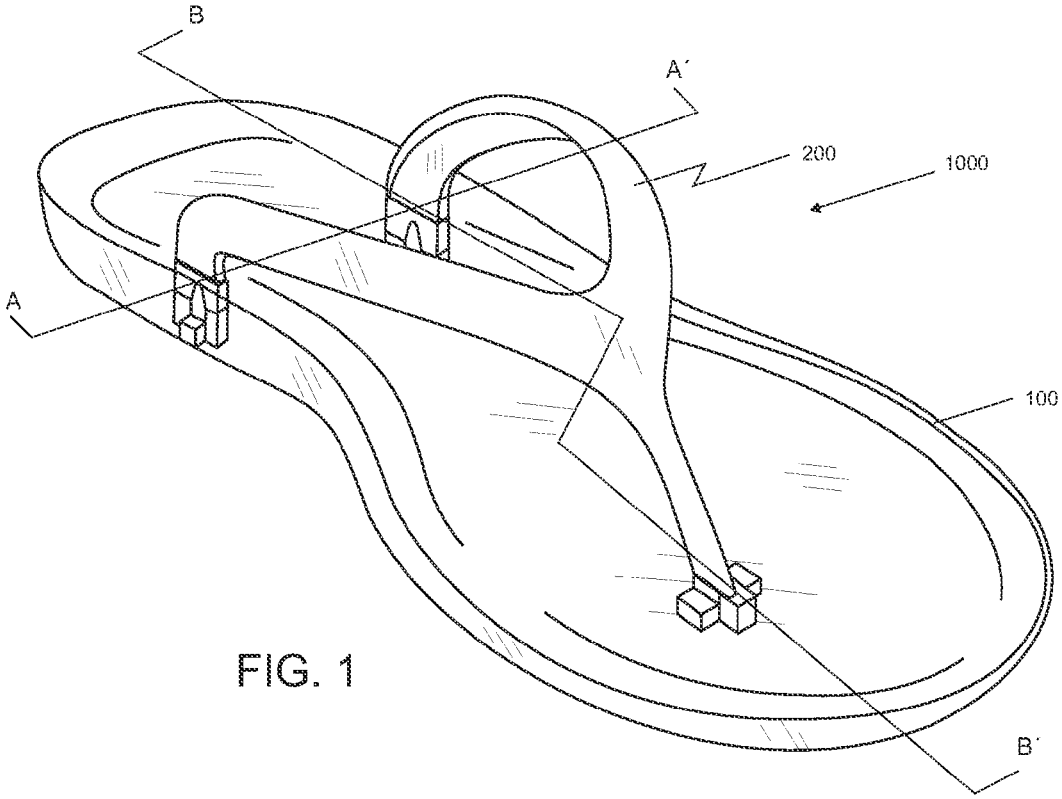
FIG. 1 is an upper front perspective and left side view of a sandal with removable straps, manufactured according to the principles of a preferred embodiment of the invention, wherein the manufacturing material is a clear plastic material.
Figure 2:
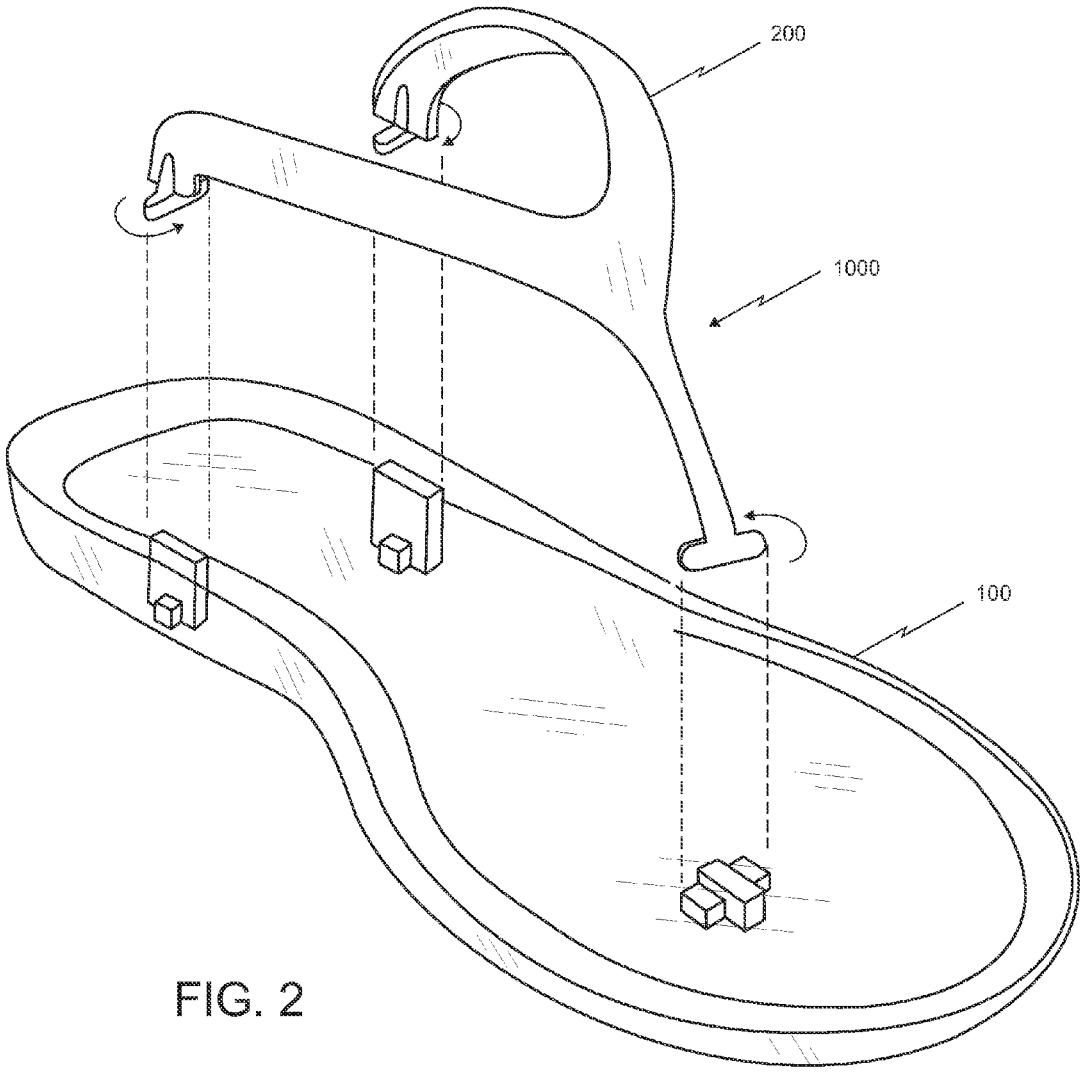
FIG. 2 is an upper front perspective and exploded left side view of the sandal with removable straps, manufactured according to the principles of the preferred embodiment of the present invention.
Figure 3:
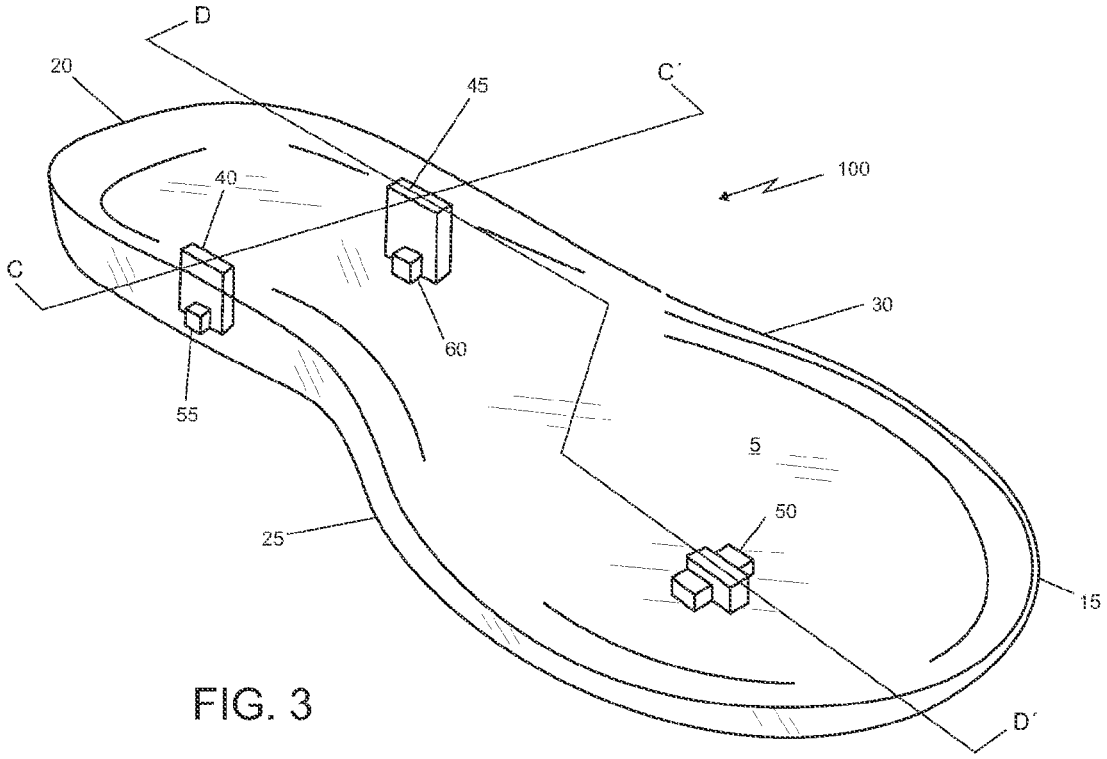
FIG. 3 is an upper front perspective and left side view of the sandal with removable straps, manufactured according to the principles of the preferred embodiment of the present invention, but showing the sandal with removed straps.
Figure 4:
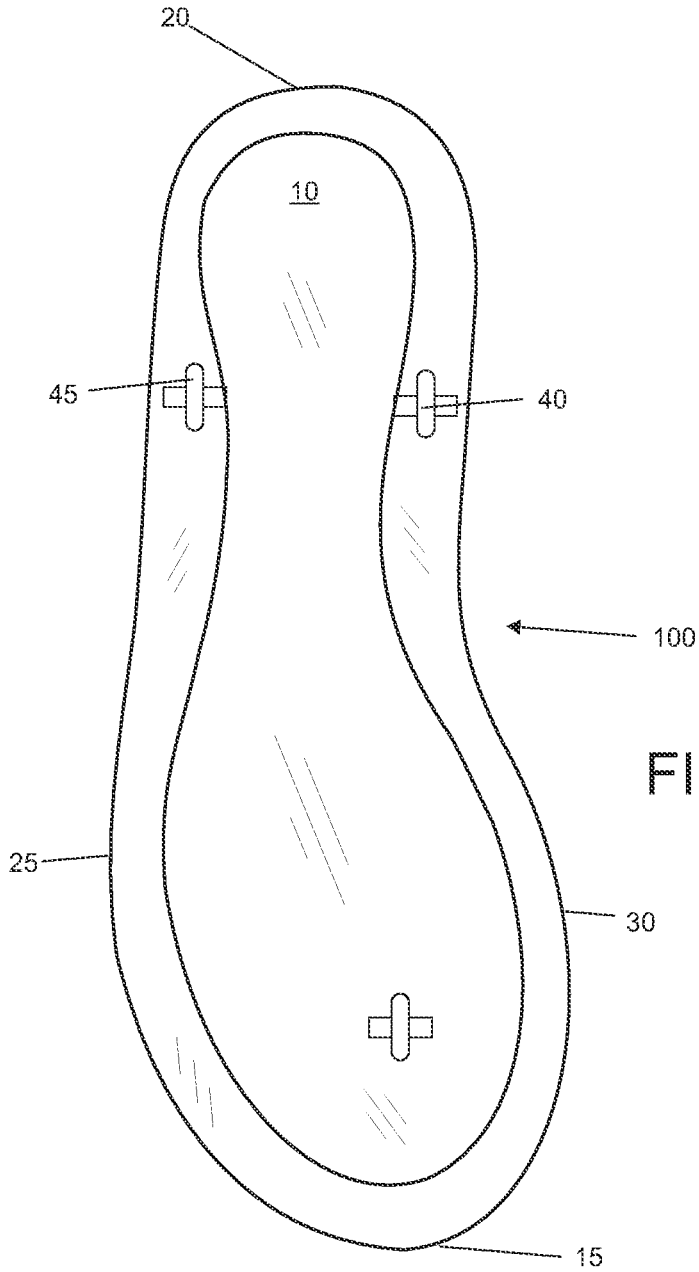
FIG. 4 is a lower plant view of the sandal shown in FIG. 2.
Figure 5:
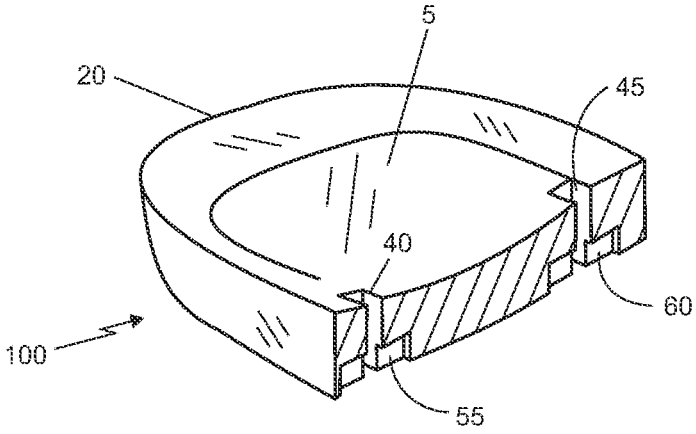
FIG. 5 is a cross-section perspective view taken along line C-C' of the sandal without straps shown in FIG. 3.
Figure 6:
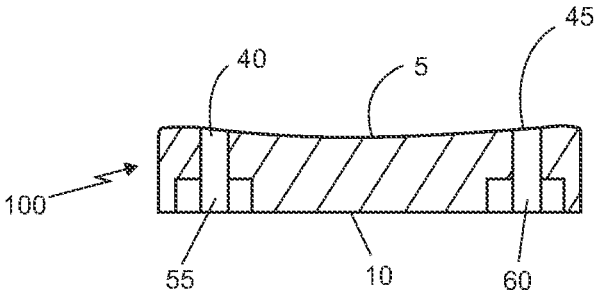
FIG. 6 is a front elevation view of the cross-section view shown in FIG. 5.
Figure 7:
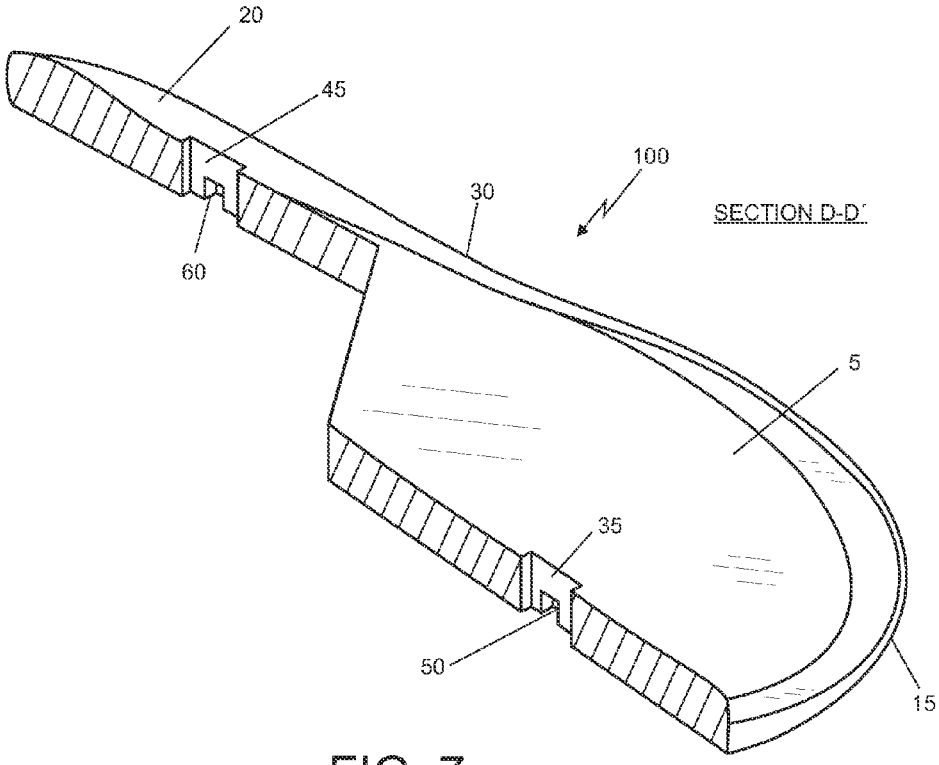
FIG. 7 is a longitudinal cross-section perspective view taken along line D-D' of the sandal shown in FIG. 3.

Particularly referring to the appended drawings, and specifically to FIG. 1, a sandal 1000 is shown, which comprises a sole 100 holding a user's foot by using holding means 200 located at the upper portion of said sandal 1000, which are removable attached to the sole 100.

Now, specifically referring to FIGS. 2 to 7 of the appended drawings, a sole 100 is shown therein, with the holding means 200 removed, wherein said sole 100 has an upper surface 5 and a lower surface 10. Likewise, the sole 100 also has a front portion 15 and a rear portion 20, along with to a left side edge 25 and a right side edge 30.

In addition, the sole 100 includes a first plurality of orifices having a geometrical shape, preferably a rectangular shape, which longitudinal axis is parallel to the sole 100 longitudinal axis, which extend from the upper surface 5 to the lower surface 10, i.e., pass throughout said sole 100 thickness. From said first plurality of orifices, a first orifice 35 is located at the front portion 15 and arranged proximal to the left side edge 25, a second orifice 40 located at the rear portion 20 and arranged proximal to the left side edge 25, and a third orifice 45 located at the rear portion 20 and arranged proximal to the right side edge, further being arranged in parallel to the second orifice 40, such that the transversal axis of said second orifice 40 and third orifice 45 is coincident.

In addition, the sole 100 includes a second plurality of orifices having a geometrical shape, preferably a rectangular shape, which longitudinal axis is perpendicular to the sole 100 longitudinal axis, which extend from the lower surface 10 to the inside of the sole 100 thickness, without passing throughout it, wherein said orifices are coincident with the orifices of the first plurality of orifices, but instead perpendicularly oriented, such that the orifices of the first plurality form a "cross" with the orifices of the second plurality, as may be noted in the appended drawings. From said second plurality of orifices, a fourth orifice 50 is located at the front portion 15 and arranged proximal to the left side edge 25 and which central axis is symmetrical to the central axis of the first orifice 35 of the first plurality of orifices, a fifth orifice 55 is located at the rear portion 20 and arranged proximal to the left side edge 25, and which central axis is symmetrical to the central axis of the second orifice 40 of the first plurality of orifices, and a sixth orifice 60 located at the rear portion 20 and arranged proximal to the right side edge, and which central axis is symmetrical to the central axis of the third orifice 45 of the first plurality of orifices, further being aligned with the fifth orifice 55, such that the longitudinal axis of said fifth orifice 55 and sixth orifice 60 is coincident.

As may be appreciated in the attached FIGS. 4 to 7, the first orifice 35, the second orifice 40, and the third orifice 45 are oriented perpendicularly to the fourth orifice 50, to the fifth orifice 55, and to the sixth orifice 60, respectively, to form a "cross", being this shape the one allowing a removal attachment of the holding means 200 to the sole 100, to make up the sandal 1000 being described in the specific embodiment of the present invention.

Figure 8:
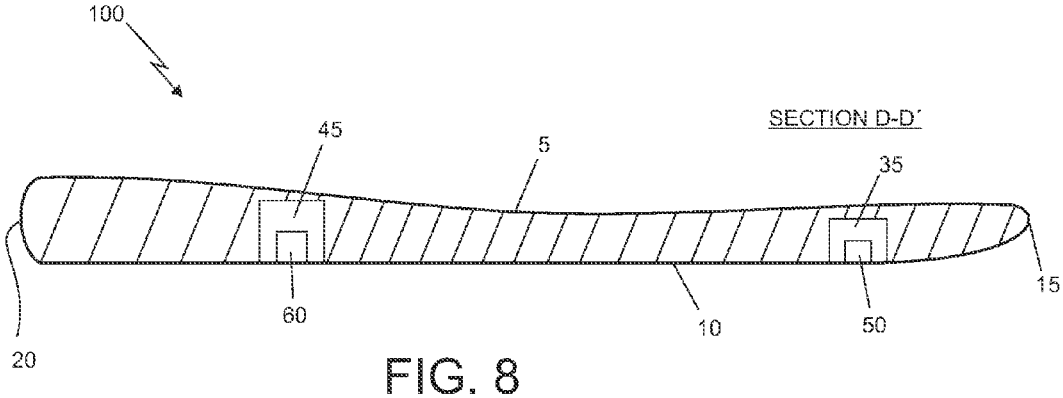
FIG. 8 is a side elevation view of the cross-section view shown in FIG. 8.
Figure 9:
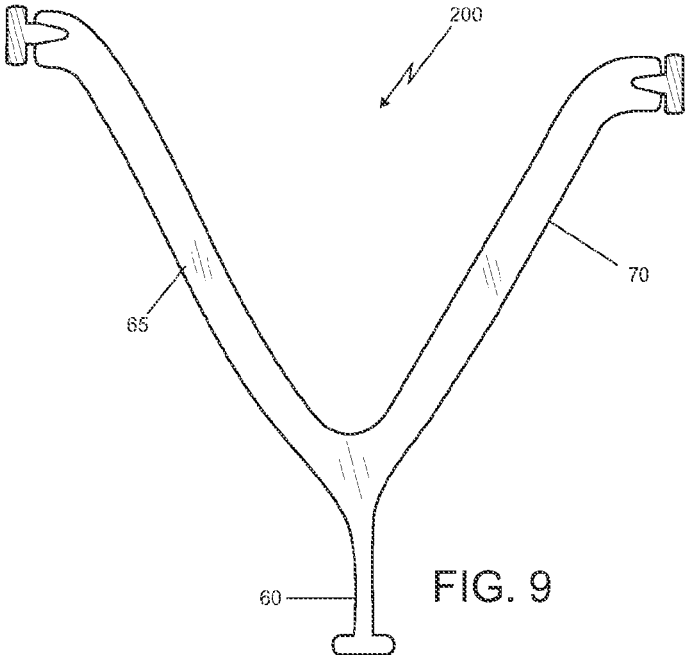
FIG. 9 is a plant view of the straps forming part of the sandal manufactured according to the principles of the preferred embodiment of the present invention.
Figure 10:
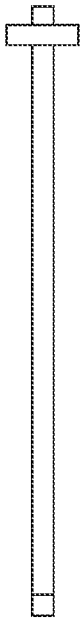
FIG. 10 is a side elevation view of the straps shown in FIG. 9.
Figure 11:
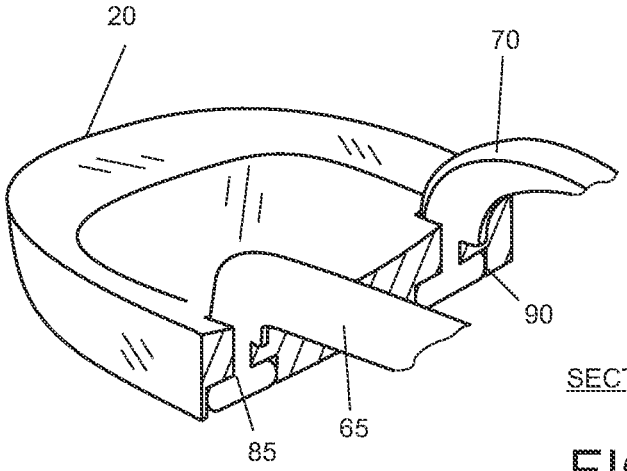
FIG. 11 is a cross-section perspective view taken along line A-A' of the sandal shown in FIG. 1.
Figure 12:
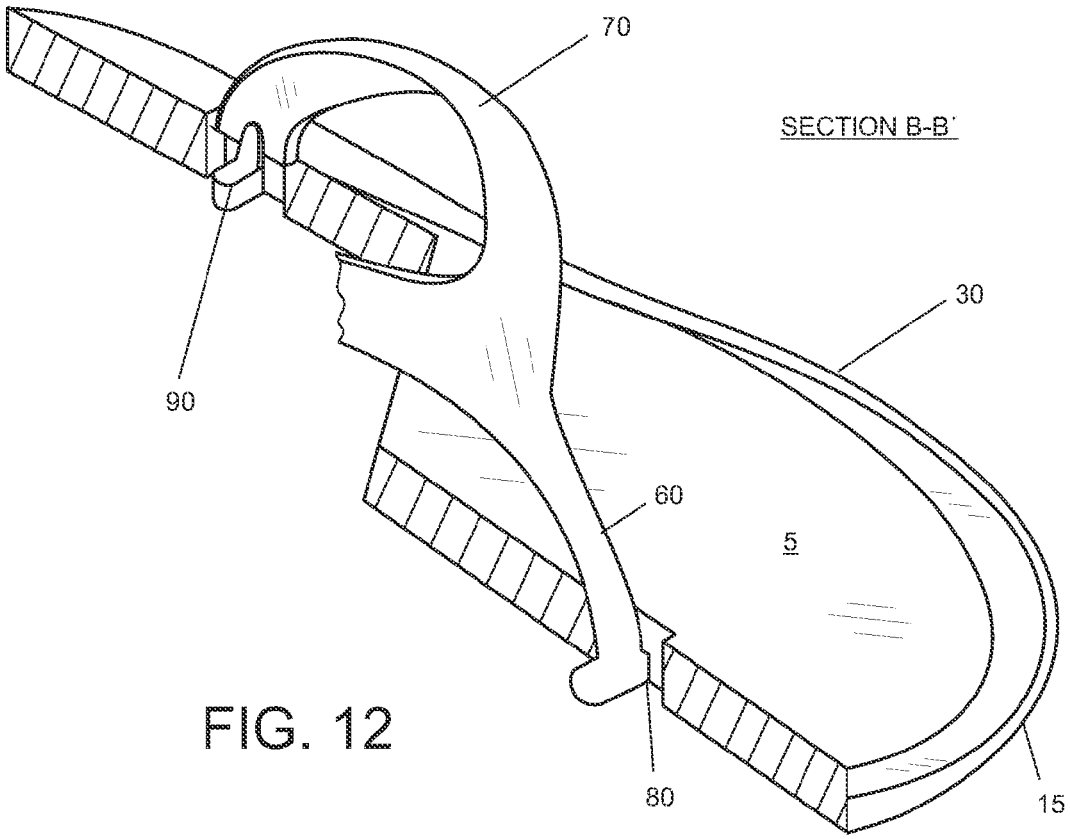
FIG. 12 is a longitudinal cross-section perspective view taken along line B-B' of the sandal shown in FIG. 1.
Figure 13:
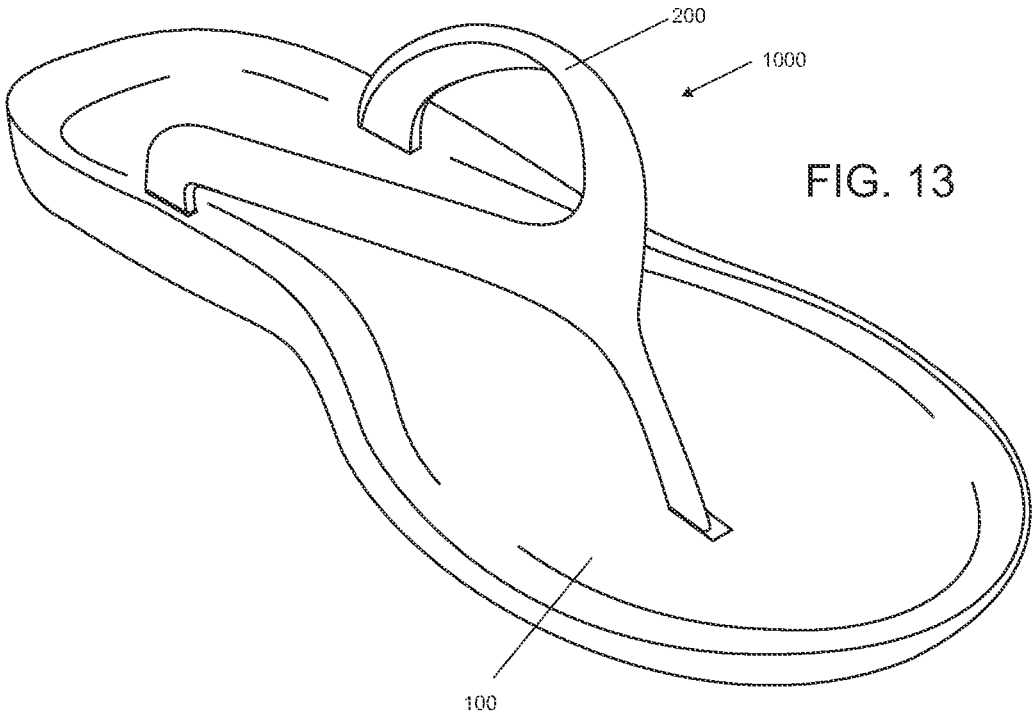
FIG. 13 is an upper front perspective and left side view of the sandal with removable straps, manufactured according to the principles of a first alternative embodiment of the present invention, wherein the manufacturing material is a non-clear plastic material.

Now then, referring more specifically to FIGS. 8 and 9 of the accompanying drawings, in they are shown the holding means 200, which in the specific embodiment of the present invention being described are referred to a body configured in a "Y" shape, which has at least three integral straps. A first strap 65 located at the "Y" bottom portion of the holding means body 200 and forming the front anchorage point 80; a second strap 70 located at the "Y" left upper portion and a third strap 75 located at the "Y" right upper portion, wherein said second 65 and third 70 straps form the rear anchorage points 85 and 90, respectively. Likewise, the second strap 65 and the third strap 70 have the same length and width dimensions, while the first strap 60 is shorter and narrower than said second 65 and third 70 straps.

The first strap 60, second strap 65, and third strap 70 ends are configured such that allow their housing in the fourth 50, fifth 55, and sixth 60 orifices respectively of the second plurality of orifices located at the lower surface 10 of the sole 100, thereby forming the front anchorage 80 and rear anchorage 85 and 90 points, as may be seen in the figures.

Now, in order to fix the holding means 200 to the sole 100 and to form a sandal 1000 of the present invention, the first strap 60 end is rotated 90° and inserted in the first orifice 35, from the upper surface 5 to the lower surface 10, and once it has passed throughout the sole 100 thickness, it is rotated 90° again, returning it to its starting position, and then it is housed in the fifth orifice 50, thereby forming the front anchorage point. In order to form the rear anchorage points 85 and 90, the same procedure of insertion and housing is followed, carried out to form the front anchorage point 80, i.e., each one of the second strap 85 and third strap 70 ends is rotated 90° and inserted in the second 40 and third 45 orifices until passing throughout the sole 100 thickness, to further rotate 90° them again, returning them to their starting position, and thereby housing them in the fifth 55 and sixth 60 orifices, respectively.

The sandal with removable straps being described in the specific embodiment of the present invention is manufactured from a preferably clear plastic material.

Now referring more specifically to FIG. 14 of the appended drawings, a sandal with removable straps according to a first alternative embodiment of the present invention is shown, wherein, the manufacturing material is a non-clear plastic material.

In view of the above, it will be apparent to those skilled in the art that the embodiments of the sandal with removable straps 1000 of the present invention, above-described and shown in the accompanying drawings, are illustrative only and non-limitative of said sandal 1000, since several modifications to said embodiments are possible, without departing of the scope of the invention, such as the orifice shape, the anchorage manner of the removable straps to the sole, the manufacturing material, etc. Therefore, the present invention shall not be considered restricted but for the prior art exigencies and by the spirit of the appended claims.

The invention claimed is:

1. A sandal with removable straps, the sandal comprising:

a sole having an upper surface, a lower surface, a front portion, a rear portion, a left side edge, a right side edge, and a sole longitudinal axis;

a holding body located at the sandal upper portion, and configured in a "Y" shape having at least three integral straps, each integral strap having an end;

a first plurality of orifices located at the sole having a longitudinal axis parallel to said sole longitudinal axis, which extend from the upper surface to the lower surface passing throughout the sole thickness; and a second plurality of orifices located at the sole having a longitudinal axis perpendicular to the sole longitudinal axis, which extend from the lower surface to the inside of the sole thickness without passing throughout the sole entirely;

wherein the orifices of the first plurality are perpendicularly oriented to the orifices of the second plurality in a "cross" configuration; and wherein the integral straps are fixed to the sole by inserting the strap ends in the orifices forming a cross, and rotating said strap ends.

2. A sandal according to claim 1, wherein the first plurality of orifices comprises:

a first orifice located at the front portion of the sole and arranged proximal to the left side edge of said sole;

a second orifice located at the rear portion of said sole and arranged proximal to the left side edge of said sole; and, a third orifice located at the rear portion of said sole and arranged proximal to the right side edge, further being arranged in parallel to the second orifice such that the transversal axis of said second and third orifices is coincident.

3. A sandal according to claim 1, wherein the orifices of the first plurality of orifices have a geometrical shape.

4. A sandal according to claim 3, wherein the orifices of the first plurality have a rectangular shape.

5. A sandal according to claim 1, wherein the second plurality of orifices comprises:

a fourth orifice located at the front portion of the sole and arranged proximal to the left side edge of said sole and which central axis is symmetrical to the first orifice central axis of the first plurality of orifices;

a fifth orifice located at the rear portion of the sole and arranged proximal to the left side edge of said sole and which central axis is symmetrical to the second orifice central axis of the first plurality of orifices; and, a sixth orifice located at the rear portion of the sole and arranged proximal to the right side edge and which central axis is symmetrical to the third orifice central axis of the first plurality of orifices, further being aligned with the fifth orifice such that the longitudinal axis of said fifth and sixth orifices is coincident.

6. A sandal according to claim 1, wherein the orifices of the second plurality have a geometrical shape.

7. A sandal according to claim 6, wherein the orifices of the first plurality have a rectangular shape.

8. A sandal according to claim 1, wherein the body configured in a "Y" shape having at least three integral straps comprises a first strap located at the "Y" bottom portion, forming a front anchorage point; a second strap located at the "Y" left upper portion; and a third strap located at the "Y" right upper portion; said second and third straps forming the rear anchorage points, and having the same length and width dimensions, while the first strap is shorter and narrower than said second and third straps.

9. A sandal according to claim 8, wherein the first, second and third strap ends are configured such that allow their housing in the fourth, fifth and sixth orifices, respectively, of the second plurality of orifices located at the sole lower surface, thereby forming the front anchorage and rear anchorage points.

10. A sandal according to claim 1, wherein in order to fix the holding body to the sole to form the sandal, the first strap end is rotated 90° and inserted in the first orifice of the first plurality of orifices, from the upper surface to the lower surface, and once the first strap end has passed throughout the sole thickness, the first strap end is rotated 90° again returning the first strap end to its starting position, and then the first strap end is housed in the fifth orifice of the second plurality of orifices thereby forming the front anchorage point; and to form the rear anchorage points, each second and third strap end is rotated 90° and inserted in the second and third orifices, respectively, of the first plurality of orifices until passing throughout the sole thickness, to further rotate them 90° again to return each second and third strap end to their starting position, and thereby housing each second and third strap end in the fifth and sixth orifices, respectively, of the second plurality of orifices.

11. A sandal according to claim 1, wherein the sandal is manufactured from a plastic material, either clear or opaque.

12. A sandal according to claim 11, wherein the sandal is manufactured from a clear material.

13. A sandal according to claim 1, wherein the orifices of the first plurality are coincident with the orifices of the second plurality.

* * * * *